US007360965B2

(12) United States Patent
Coscarella

(10) Patent No.: US 7,360,965 B2
(45) Date of Patent: Apr. 22, 2008

(54) CLEANOUT WITH DRAINAGE CAPABILITIES

(76) Inventor: Gabe Coscarella, 15703-64 Street, Edmonton, Alberta (CA) T5Y 2N5

( * ) Notice: Subject to any disclaimer, the term of this patent is extended or adjusted under 35 U.S.C. 154(b) by 742 days.

(21) Appl. No.: 10/691,463

(22) Filed: Oct. 21, 2003

(65) Prior Publication Data

US 2005/0072080 A1 Apr. 7, 2005

(30) Foreign Application Priority Data

Oct. 21, 2002 (CA) ..... 2409056

(51) Int. Cl.
*E02B 11/00* (2006.01)

(52) U.S. Cl. ..... 405/40

(58) Field of Classification Search ..... 405/39, 405/41, 42; 52/107; 251/120–121, 205, 251/340

See application file for complete search history.

(56) References Cited

U.S. PATENT DOCUMENTS

| | | | | |
|---|---|---|---|---|
| 214,894 | A * | 4/1879 | Draper | 405/42 |
| 540,297 | A | 6/1895 | Brintnall | |
| 1,109,740 | A | 9/1914 | Dehn | |
| 1,731,617 | A * | 10/1929 | Fleming | 210/165 |
| 2,898,129 | A | 8/1959 | Sisk | |
| 3,469,698 | A * | 9/1969 | Blendermann | 210/163 |
| 3,638,431 | A * | 2/1972 | Shelander | 405/53 |
| 3,774,765 | A | 11/1973 | Kane et al. | |
| 3,973,407 | A | 8/1976 | Vecchio | |
| 5,431,815 | A * | 7/1995 | Te-Shin | 210/459 |
| 5,970,664 | A * | 10/1999 | Janesky | 52/107 |

FOREIGN PATENT DOCUMENTS

| | | |
|---|---|---|
| CA | 1010743 | 5/1977 |

* cited by examiner

*Primary Examiner*—John Kreck
(74) *Attorney, Agent, or Firm*—Christensen O'Connor Johnson Kindness PLLC

(57) ABSTRACT

A cleanout with adjustable subsurface drainage capabilities which includes a first body and a second body. The first body has a first sidewall and a top access opening. The first sidewall has a plurality of circumferentially spaced and axially oriented first slots. A removable liquid impervious closure closes the top access opening. The second body has a second sidewall and a bottom access opening. The second sidewall has a plurality of circumferentially spaced and axially oriented second slots. The first body and the second body are rotatably engaged with the first sidewall and the second sidewall overlapping. A slot open flow area is provided where the first slots and the second slots overlap. Relative rotation of the first body and the second body alters the relative circumferential spacing of the first slots and the second slots placing them either out of register, partially in register or fully in register and thereby altering the width of the slot open flow area.

5 Claims, 8 Drawing Sheets

CLEANOUT WITH DRAINAGE CAPABILITIES

FIELD OF THE INVENTION

The present invention relates to a cleanout with drainage capabilities.

BACKGROUND OF THE INVENTION

A cleanout generally consists of a hollow body having a upper access opening and a lower access opening. The lower access opening is adapted for connection to an underground conduit. The upper access opening is closed by a closure to keep out debris. Should problems be encountered with flow through the underground conduit, access is obtained via the closure of the cleanout for the purpose of flushing or removing debris from the underground conduit. A cleanout does not have drainage capabilities.

SUMMARY OF THE INVENTION

The present invention relates to a cleanout with drainage capabilities.

According to the present invention there is provided a cleanout with drainage capabilities which includes a hollow housing made from at least one body having a sidewall, a top access opening, and a bottom access opening. The sidewall has a plurality of drainage openings. A removable closure closes the top access opening.

When buried with the top access opening with removable closure accessible from above surface, the cleanout, as described above, provides ground drainage through the drainage openings in the side wall. The removable closure keeps out debris.

Although beneficial results may be obtained through the use of the cleanout with drainage capabilities, as described above, it is preferred that the flow through the drainage openings be adjustable to suit different installation requirements. Even more beneficial results may, therefore, be obtained when a first body is provided having a first sidewall and a top access opening. The first sidewall has a plurality of circumferentially spaced and axially oriented first slots. A second body is provided having a second sidewall and a bottom access opening. The second sidewall has a plurality of circumferentially spaced and axially oriented second slots. The first body and the second body are rotatably engaged with the first sidewall and the second sidewall overlapping. A slot open flow area is provided where the first slots and the second slots overlap. Relative rotation of the first body and the second body altering the relative circumferential spacing of the first slots and the second slots placing them either out of register, partially in register or fully in register and thereby altering the width of the slot open flow area.

By relative rotation of the first body and the second body, the cleanout described above can be provided with subsurface drainage capabilities. For example, this is useful for cleanouts to weeping tile pipe positioned in window wells. Window well drains sometimes have drainage problems as a result of clogging. This may be due to sand and silt clogging up the gravel filters in the window well drains. It also may be due to seasonal problems, such as ice formations due to the restricted flow of water in the well caused by it filtering down rather than having an open channel. The ability to selectively open and close the slot open flow area provides an advantage, particularly with respect to the size of granular material. Without such capabilities there is a danger that slow drainage will result in water backing up and flowing into the house.

Although beneficial results may be obtained through the use of the cleanout, as described above, measures can be taken to further control the slot open flow. Even more beneficial results may be obtained when the first body and the second body have limited axial movement toward and away from each other. Relative axial movement of the first body and the second body adjusts the length of the slot open flow area.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
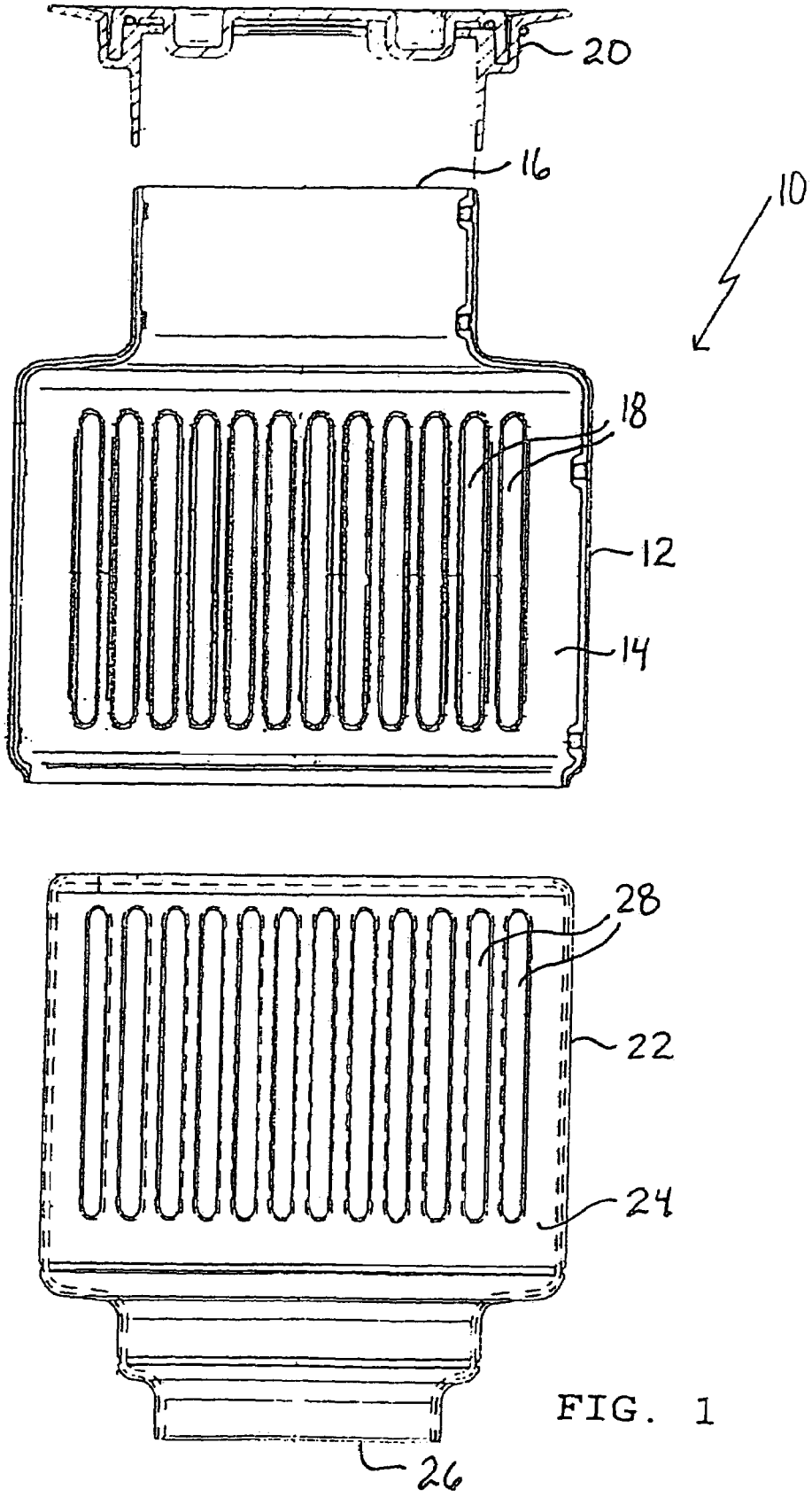
FIG. 1 is an exploded view of a cleanout with adjustable subsurface drainage capabilities constructed accordance with the teachings of the present invention.

The preferred embodiment, a cleanout with adjustable subsurface drainage capabilities generally identified by reference numeral 10, will now be described with reference to FIGS. 1 through 8.

Structure and Relationship of Parts:

Referring to FIG. 1, cleanout 10 has a hollow housing made from two components, a first body 12 and a second body 14. First body 12 has a first sidewall 14 and a top access opening 16. First sidewall 14 has a plurality of circumferentially spaced and axially oriented first slots 18. A removable liquid impervious closure 20 is provided which closes top access opening 16. Second body 22 has a second sidewall 24 and a bottom access opening 26. Second sidewall 24 has a plurality of circumferentially spaced and axially oriented second slots 28.

Figure 2:
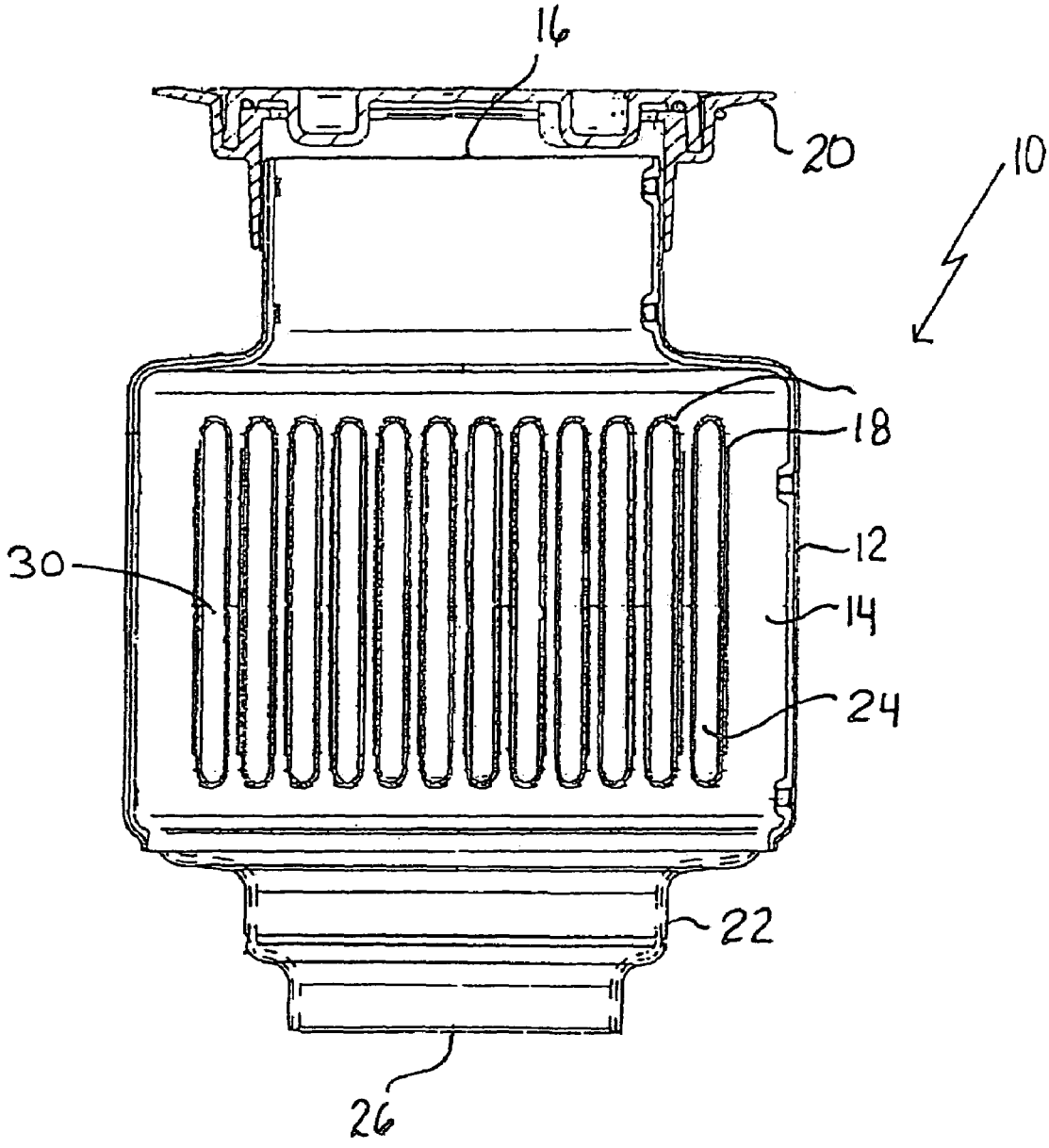
FIG. 2 is a side elevation view of the cleanout illustrated in FIG. 1 with the first slots out of register with the second slots.
Figure 3:
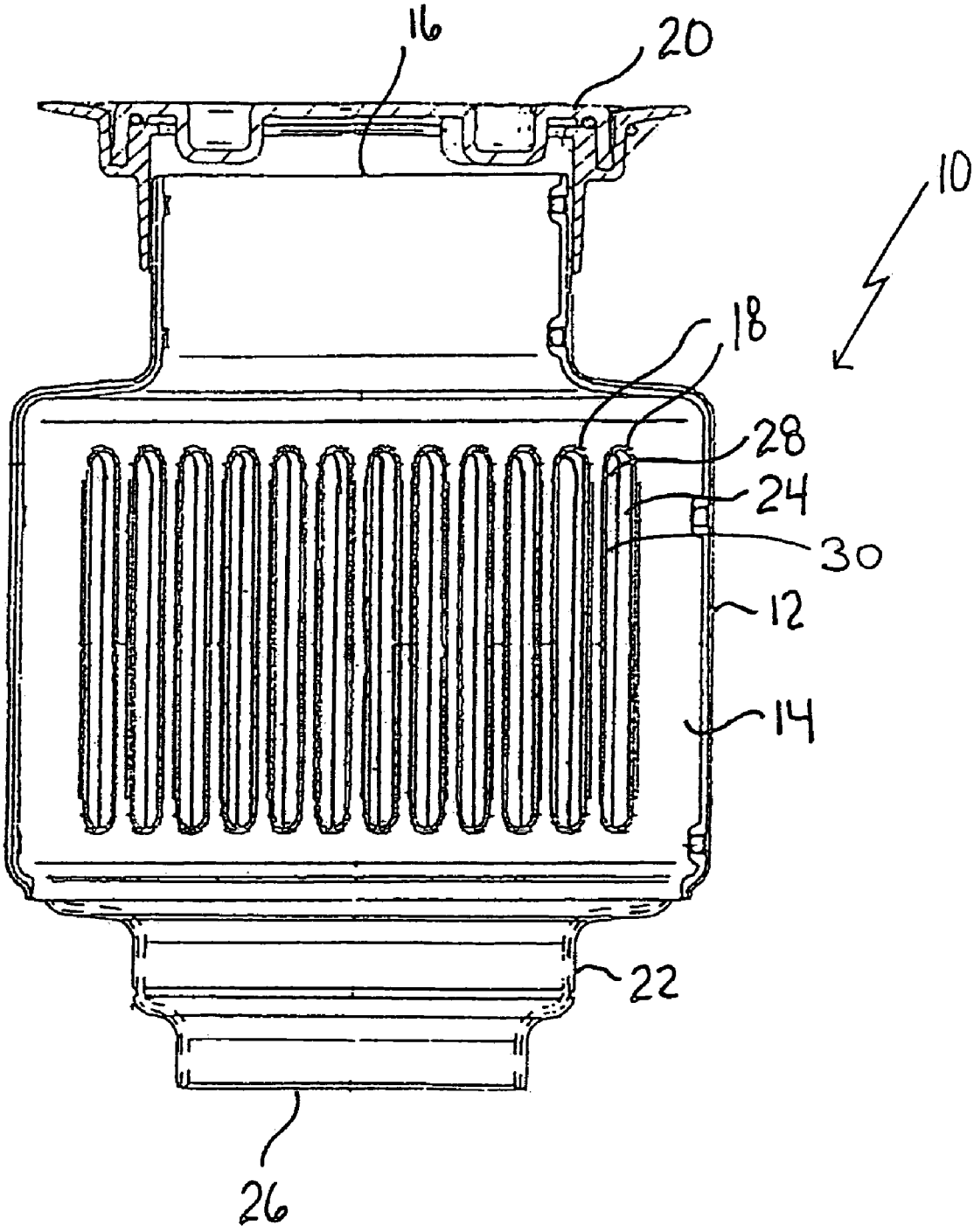
FIG. 3 is a side elevation view of the cleanout illustrated in FIG. 1 with the first slots partially in register with the second slots.
Figure 4:
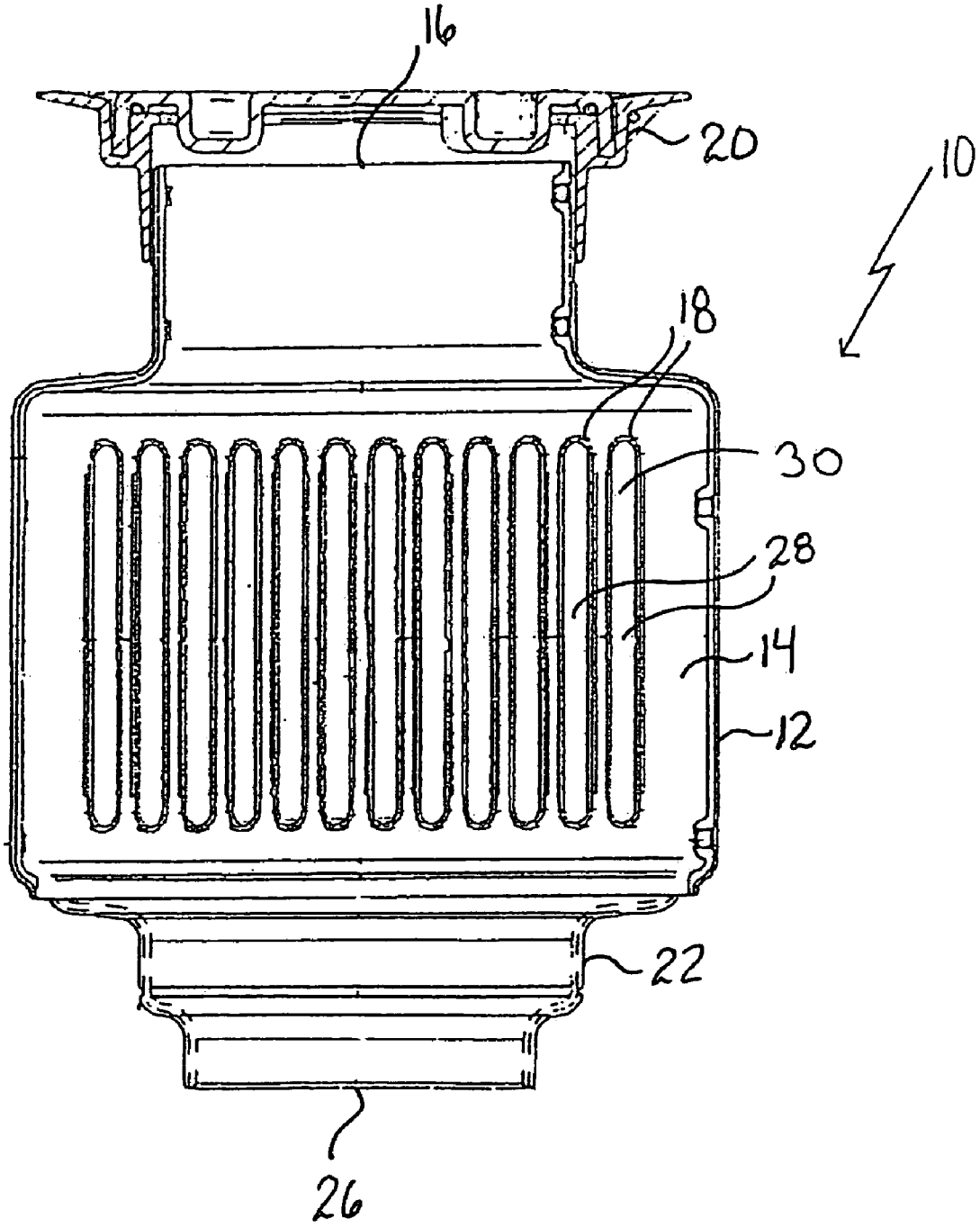
FIG. 4 is a side elevation view of the cleanout illustrated in FIG. 1 with the first slots in register with the second slots.

Referring to FIG. 2, first body 12 and second body 22 are rotatably engaged with first sidewall 14 and second sidewall 24 overlapping. A slot open flow area 30 is provided where first slots 18 and second slots overlap 28. Relative rotation of first body 12 and second body 24 altering the relative circumferential spacing of first slots 18 and second slots 28 by placing them either out of register as illustrated in FIG. 2, partially in register as illustrated in FIG. 3, or fully in register as illustrated in FIG. 4, and thereby altering the width of slot open flow area 30. In FIG. 2 the slot flow area 30 is nil, such that there is no flow. In FIG. 3 the slot flow area 30 is only 50% of capacity. In FIG. 4 the slot flow area 30 is 100% of capacity.

Figure 5:
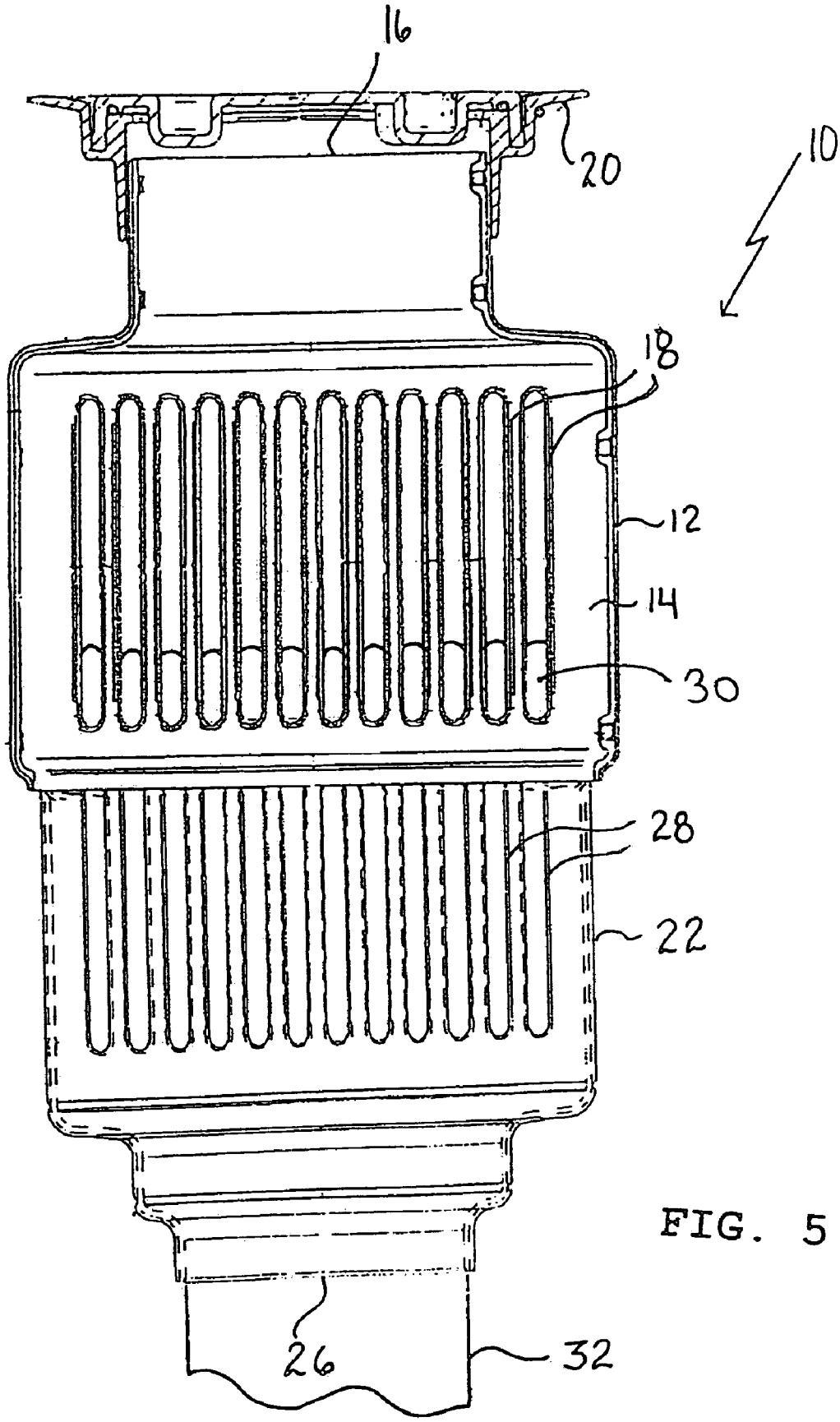
FIG. 5 is a side elevation view of the cleanout illustrated in FIG. 1 with the first body being axially extended relative to the second body.

Referring to FIG. 5, first body 12 and second body 22 have limited axial movement toward and away from each other. Relative axial movement of first body 12 and second body 22 adjusts the length of slot open flow area 30. This serves to further selectively increase or diminish slot open flow area 30.

Operation:

The use and operation of cleanout with adjustable subsurface drainage capabilities generally identified by reference numeral 10, will now be described with reference to FIGS. 1 through 8.

Figure 6:
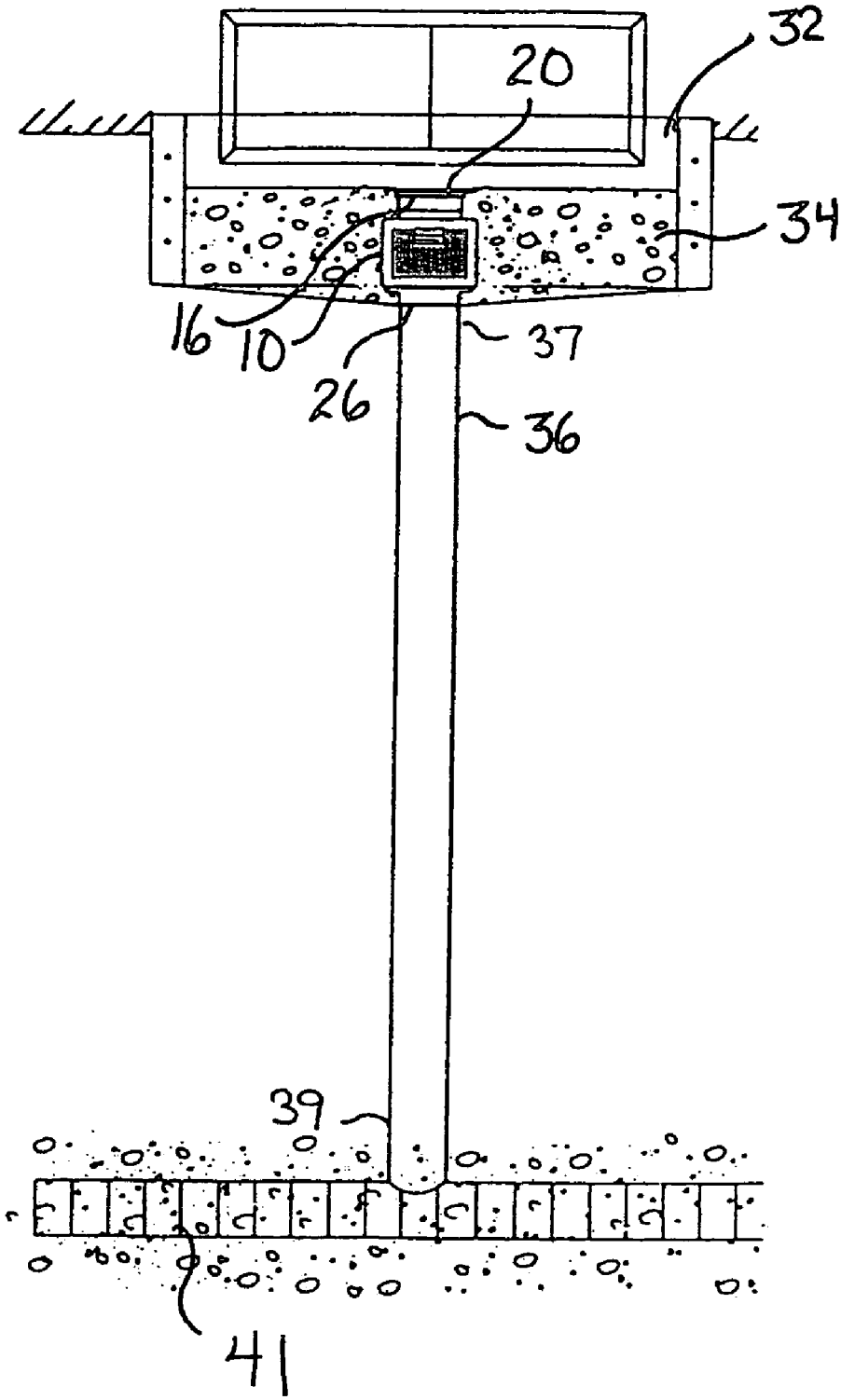
FIG. 6 is a side elevation view of the cleanout illustrated in FIG. 1 installed as a window well drain.

Referring to FIGS. 6 though 8, cleanout 10, as described above, is suitable for a variety of installations such as a window well drain, as part of a weeping tile flushing system, or as part of a subsoil drainage system in areas where water pools such as under concrete slabs. Referring to FIG. 6, when installed in a window well 32 as window well drain, cleanout 10 provides rapid drainage of window well 32 which helps to eliminate freezing of window well 32 in cold temperatures. When installed in soil 34 beneath window well 32, bottom access opening 26 of cleanout 10 is connected to a hollow underground conduit 36 for subterranean drainage. Conduit 36 has an upper end 37 and a remote end 39. Upper end 37 is connected to bottom access opening 26. Remote end 39 is connected to underground weeping tile 41. Removable liquid impervious closure 20 that closes top access opening 16 may be transparent to permit viewing of inside of cleanout 10. Referring to FIGS. 2 through 4, relative rotation of first body 12 and second body 22, to selectively open and close slot open flow area 30 along with relative axial movement of first body 12 and second body 22 to adjust the length of slot open flow area 30 as illustrated in FIG. 5, allows for slot open flow area 30 to be adjusted to accommodate particular draining problems. Window well drains, for example, sometimes have drainage problems as a result of clogging which can be due to sand and silt clogging up the gravel filters or seasonal problems, such as ice formations. Without the ability to adjust slot open flow area 30 there is a danger that slow drainage will result in water backing up and causing damage to a house.

Figure 7:
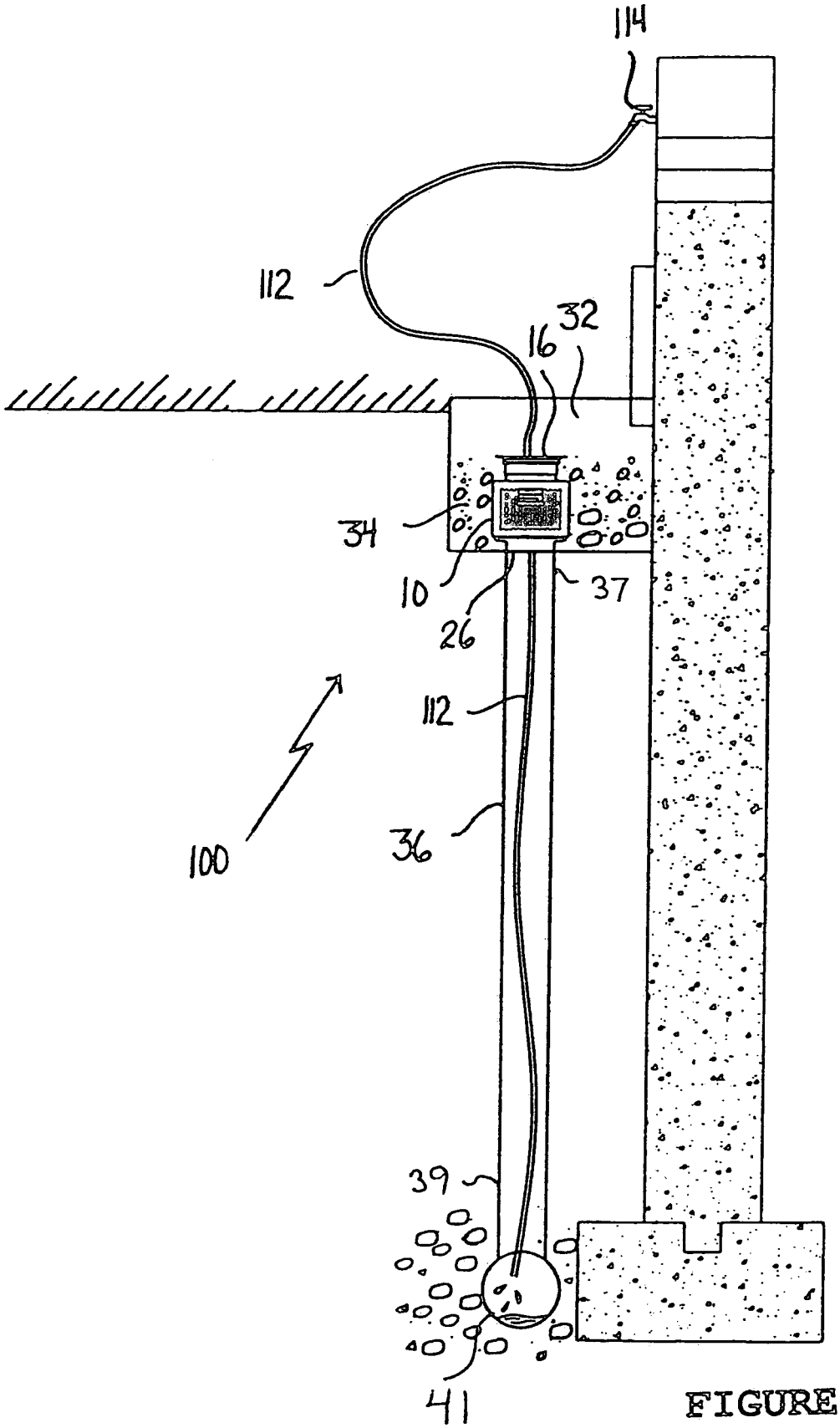
FIG. 7 is a side elevation view of the cleanout illustrated in FIG. 1 installed as a weeping tile flushing system.

Referring to FIG. 7, cleanout 10 can be installed as part of a weeping tile flushing system 100. To do so, cleanout 10 can be installed in a similar manner as is illustrated in FIG. 6. When flushing is required, closure 20 is removed from top access opening 16 of cleanout 10 so a water hose 112 from a water supply such as a faucet 114 can be passed through cleanout 10 and down hollow underground conduit 36. When facet 114 is turned on, flowing water flushes out common weeping tile blockages. After flushing is completed, water hose 112 can be removed from hollow underground conduit 36 and cleanout 10. Closure 20 can be replaced on opening 16 to prevent debris from falling into cleanout 10.

Figure 8:
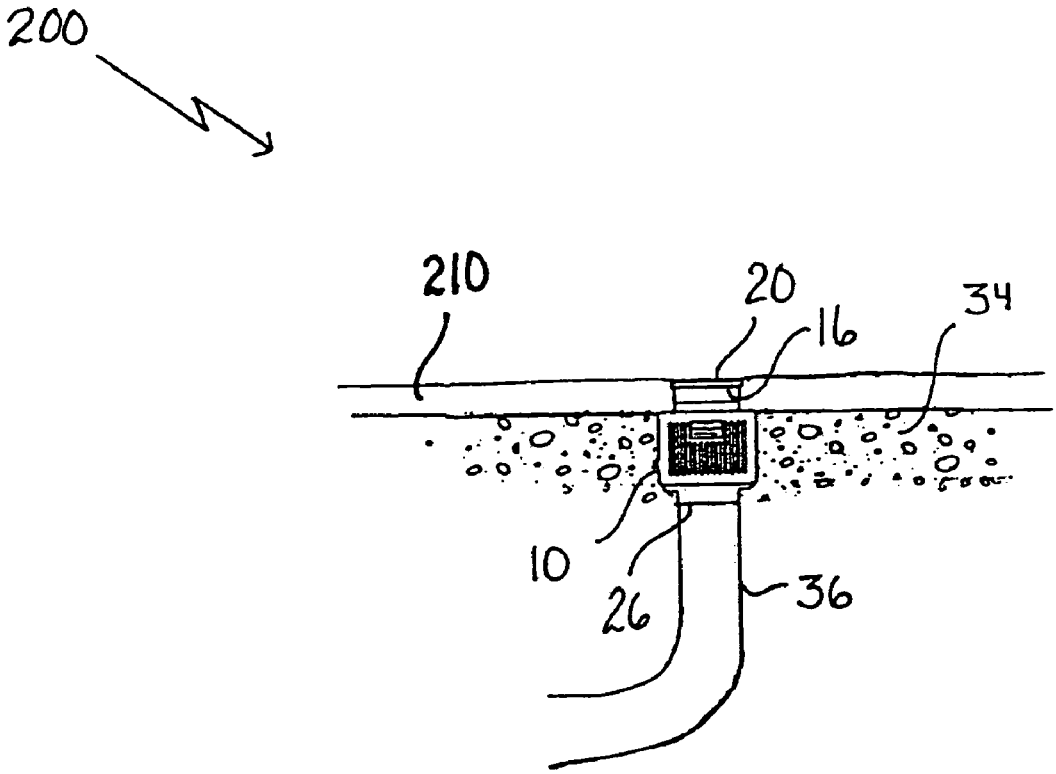
FIG. 8 is a side elevation view of the cleanout illustrated in FIG. 1 installed beneath concrete slabs.

Referring to FIG. 8, cleanout 10 can also be installed as part of a subsoil drainage system 200 in areas where water pools such as under concrete slabs 210. Where cleanout 10 is installed for this purpose, closure 20 is sealed. Water build up beneath concrete slab 210 is allowed to drain via cleanout 10 and hollow underground conduit 36. This prevents a build up in water pressure beneath concrete slab 210, as well as eliminate seeping between the cracks in concrete slab 210.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A cleanout with drainage capabilities, comprising:

a first body having a first sidewall and a top access opening, the first sidewall having a plurality of circumferentially spaced and axially oriented first slots;

a removable closure closing the top access opening;

a second body having a second sidewall and a bottom access opening, the second sidewall having a plurality of circumferentially spaced and axially oriented second slots;

the first body and the second body being rotatably engaged with the first sidewall and the second sidewall overlapping, a slot open flow area being provided where the first slots and the second slots overlap, relative rotation of the first body and the second body altering the relative circumferential spacing of the first slots and the second slots placing them either out of register, partially in register or fully in register and thereby altering the width of the slot open flow area; and the first body and the second body having limited axial movement toward and away from each other, relative axial movement of the first body and the second body adjusting the combined length of the axially oriented first slots and the axially oriented second slots to increase the slot open flow area linearly throughout the limited axial movement of the first body and the second body.

2. In combination:

a cleanout with drainage capabilities, comprising:

a hollow housing made from at least one body having a sidewall, a top access opening, and a bottom access opening, the sidewall having a plurality of drainage openings; and a removable closure closing the top access opening;

the cleanout being buried with the bottom access opening attached to an underground conduit and the top access opening with removable closure being accessible from above ground, with the drainage openings providing ground drainage, wherein the housing is positioned within a gravel filter of a window well.

3. The combination as defined in claim 2, wherein a remote end of the underground conduit is connected to weeping tile.

4. In combination:

a cleanout, comprising:

a first body having a first sidewall and a top access opening, the first sidewall having a plurality of circumferentially spaced and axially oriented first slots;

a removable closure closing the top access opening;

a second body having a second sidewall and a bottom access opening, the second sidewall having a plurality of circumferentially spaced and axially oriented second slots; and the first body and the second body being rotatably engaged with the first sidewall and the second sidewall overlapping, a slot open flow area being provided where the first slots and the second slots overlap, relative rotation of the first body and the second body altering the relative circumferential spacing of the first slots and the second slots placing them either out of register, partially in register or fully in register and thereby altering the width of the slot open flow area;

an underground conduit being provided having an upper end and a remote end;

the cleanout being buried within a gravel filter of a window well with the bottom access opening attached to the upper end of the underground conduit and the top access opening with removable closure being accessible from above ground, slot open flow area providing ground drainage;

the remote end of the underground conduit being connected to weeping tile.

5. The combination as defined in claim 4, wherein the first body and the second body have limited axial movement toward and away from each other, relative axial movement of the first body and the second body adjusting the length of the slot open flow area.

* * * * *